US005603400A

United States Patent [19]

Goto et al.

[11] Patent Number: 5,603,400

[45] Date of Patent: Feb. 18, 1997

[54] ROCKER SWITCH

[75] Inventors: Kazuhiro Goto, Markham; Andrew M. Wilson, Alliston, both of Canada

[73] Assignee: The Whitaker Corporation, Wilmington, Del.

[21] Appl. No.: 590,983

[22] Filed: Jan. 24, 1996

[51] Int. Cl.[6] ..... H01H 19/06

[52] U.S. Cl. ..... 200/302.3; 200/557; 200/553; 200/339

[58] Field of Search ..... 200/557, 302.3, 200/302.1, 561, 553, 554, 555, 556, 558, 559, 560, 562, 563, 339

[56] References Cited

U.S. PATENT DOCUMENTS

| | | | |
|---|---|---|---|
| 3,219,784 | 11/1965 | Toruk et al. | 200/561 |
| 3,654,415 | 4/1972 | Hawkins et al. | 200/168 G |
| 3,668,938 | 6/1972 | Dimitry | 74/18.1 |
| 4,105,882 | 8/1978 | Ulbing et al. | 200/157 |
| 4,152,563 | 5/1979 | Bongort | 200/157 |
| 4,218,602 | 8/1980 | Creech | 200/302 |
| 4,242,551 | 12/1980 | Sorenson | 200/302 |
| 4,340,791 | 7/1982 | Sorenson | 200/302 |
| 4,401,864 | 8/1983 | Ichikawa | 200/17 R |
| 4,408,103 | 10/1983 | Smith, III | 200/6 A |
| 4,654,488 | 3/1987 | Westfall | 200/5 R |
| 4,710,602 | 12/1987 | Baity et al. | 200/315 |
| 4,861,950 | 8/1989 | Yanai et al. | 200/302.3 |
| 4,883,932 | 11/1989 | VanHout et al. | 200/339 |
| 4,896,003 | 1/1990 | Hsieh | 200/6 A |
| 4,918,264 | 4/1990 | Yamamoto et al. | 200/5 R |
| 4,929,804 | 5/1990 | Kawai et al. | 200/5 A |
| 5,087,798 | 2/1992 | Rohde et al. | 200/5 A |
| 5,147,990 | 9/1992 | Dionisio, Jr. et al. | 200/16 R |
| 5,396,030 | 3/1995 | Matsumiya et al. | 200/6 A |
| 5,508,479 | 4/1996 | Schooley | 200/557 |

*Primary Examiner*—David J. Walczak

[57] ABSTRACT

The invention comprises a rocker switch which includes a rocker member having an actuating surface, a bottom surface, and a pivot member. A circuit board has a dome switch mounted thereon. A bracket is secured to the circuit board having a pivot guide to receive the pivot member. A elastomeric member is received between the bottom surface of the rocker member and the dome switch. Actuation of the rocker member presses the bottom surface of the rocker member against the elastomeric member which presses against the dome switch thereby activating the switch.

20 Claims, 4 Drawing Sheets

ROCKER SWITCH

FIELD OF THE INVENTION

The invention relates to a rocker switch, and more particularly, to a rocker switch which activates a dome switch.

BACKGROUND OF THE INVENTION

Membrane switches are well known as a method to activate switches in consumer products. These switches are typically either of the electromechanical type of switch or the elastomeric membrane switch. U.S. Pat. No. 5,147,990 shows the use of a slide switch to activate the elastomeric membrane switch. A slide switch activates a cantilevered beam which is pressed onto an elastomeric keypad. A conductive pad on the elastomeric keypad is then pushed into contact with traces on the keypad.

U.S. Pat. No. 4,401,864 shows a rocker switch that is used to activate electromechanical switches mounted on a substrate. The switch has a return member which returns the switch to a neutral position so that it is ready for the next switching operation.

When a rocker switch is used on a piece of outdoor equipment, such as a snowmobile, it is necessary to build a rocker switch that provides greater tactile feel. When the equipment is in operation, it is necessary to provide a switch in which the operator can feel that he has activated the switch. This feel must be detectable through equipment vibration and also through layers of clothing. It is also necessary to protect the underlying switches from damage due to excess force and from damage due to ice build up.

SUMMARY OF THE INVENTION

The invention comprises a rocker switch which includes a rocker member having an actuating surface, a bottom surface, and a pivot member. A circuit board has a dome switch mounted thereon. A bracket is secured to the circuit board having a pivot guide to receive the pivot member. A elastomeric member is received between the bottom surface of the rocker member and the dome switch. Actuation of the rocker member presses the bottom surface of the rocker member against the elastomeric member which presses against the dome switch thereby activating the switch.

The invention further comprises a rocker switch which includes a switch member having an actuation surface, a working surface, and a pivot member. A circuit board has a dome switch thereon. A bracket member is secured to the circuit board and has a pivot guide to position the switch member over the dome switch while allowing rocking motion thereof. A elastomeric member is received between the switch member and the circuit board. Actuation of the switch member presses the working surface against the elastomeric member which presses the dome switch thereby activating the switch. The elastomeric member distributes the load across the circuit board thereby protecting the dome switch from high forces and preventing moisture from accumulating between the circuit board and the switch member to prevent ice damage to the circuit board and the dome switch.

BRIEF DESCRIPTION OF THE DRAWINGS

Embodiments of the present invention will now be described by way of example with reference to the accompanying drawings, in which.

DETAILED DESCRIPTION OF THE INVENTION

Figure 1:
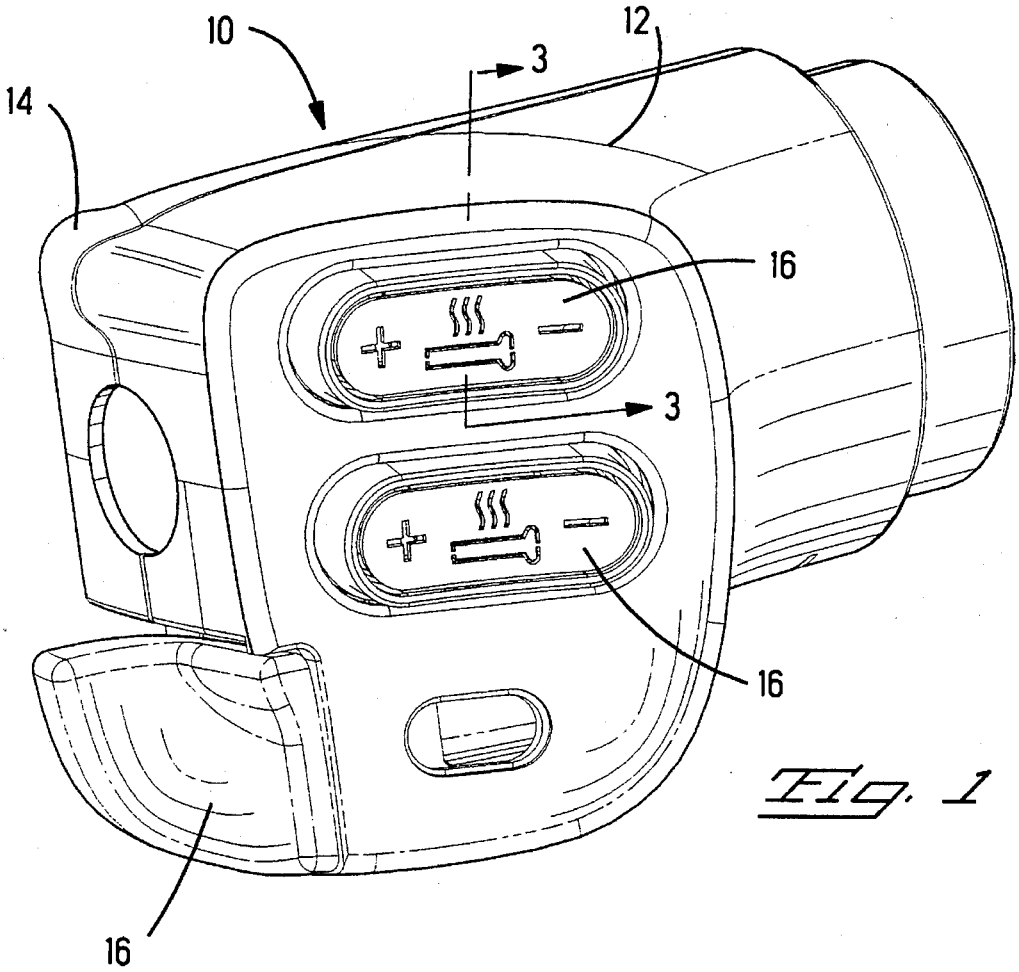
FIG. 1 is an isometric view of the handlebar unit of the present invention.

FIG. 1 shows a handlebar unit 10 which can be mounted onto the handlebar of a snowmobile or some other piece of outdoor equipment. The unit 10 includes a top housing 12 and a bottom housing 14. Along the top face of the top housing 12 are several switch members 16 which are arranged so that the operator can easily access the switch members while operating the vehicle, without taking his hands off the handlebars. These switches can be used to operate lights, heat, horn, or some other feature that an operator would desire to switch on or off during the operation of the vehicle.

Figure 2:
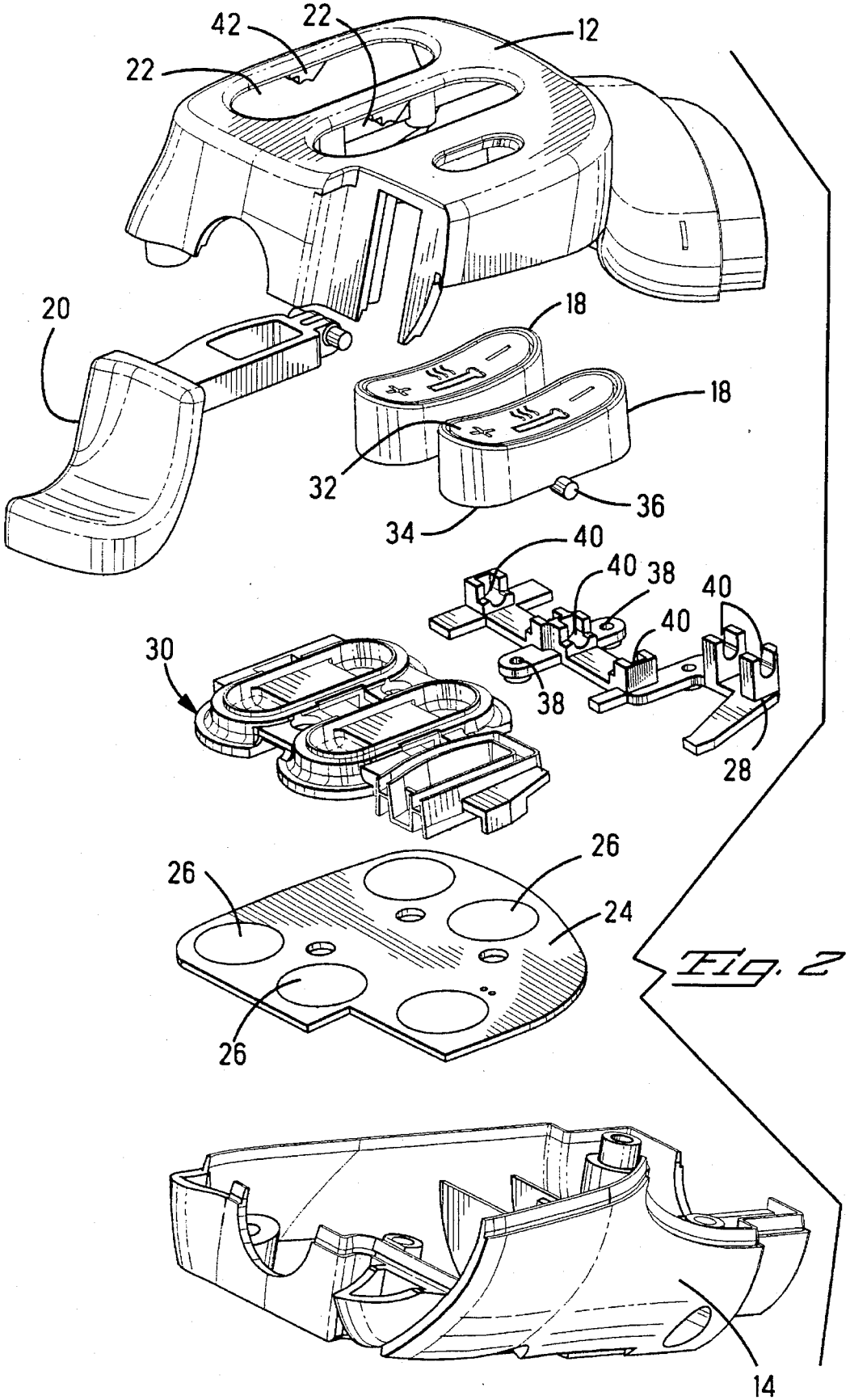
FIG. 2 is an exploded view of the handlebar unit showing the components of the rocker switch.

FIG. 2 is an exploded view of the unit 10 showing the top housing 12; the bottom housing 14, and the assembly therein. In this representative embodiment, the switch members 16 include two rocker switches 18 and one lever switch 20. The rocker switches 18 are received through holes 22 in the top housing so that they are accessible from the outside to be activated by the operator.

A printed circuit board 24 is received within the bottom housing 14. The board 24 has a series of dome switches 26 mounted thereon over a series of electrical traces on the board. The dome switch is represented without detail and will be explained in more detail with regard to FIG. 6. The dome switches 26 are preferably metal in order to provide better tactile feel, however, they could also be plastic. A bracket 28 is secured to the board 24 to provide a mount for the rocker switches 18 and the lever switch 20. A silicon pad 30 is received over the bracket 28 and the switches 18,20 are mounted on top of the silicon pad 30. The preferred embodiment utilizes a silicon pad, however, the silicon pad could be some other elastomeric member that is capable of providing the appropriate properties of activating the dome switch with the necessary tactile feel and preventing moisture build up between the elastomeric member and the dome switch. The representative embodiment shows two individual rocker switches 18, however, the invention could also be used with other numbers or arrangements of rocker switches. The bracket is designed as one piece such that it can secure all three switches 18,20 to the circuit board 24. The silicon pad 30 is also designed as one piece to be received under the rocker switches, but it would be possible to have the bracket 28 and the silicon pad 30 exist as individual pieces to accommodate the individual switches 18, 20.

The switches 18 each have a top surface 32 which are actuation surfaces to be engaged by the operator. The switch 18 also has a bottom surface 34 which is used to activate the dome switch 26. A pivot pin 36 extends from either side of the switch 18 (only one of which is shown in FIG. 2) along the bottom surface of the switch 18.

The bracket has mounting holes 38 which are used to secure to the board 24. The bracket 28 has several upstanding projections having cradle recesses 40 to receive the pivot pin 36 of the rocker switch. The cradle recesses 40 are U-shaped recesses that will receive the pivot pin 36 while allowing the pivot pin to rotate within the recess 40. The bracket 28 has two cradle recesses 40 for each switch that will be mounted thereon.

Figure 3:
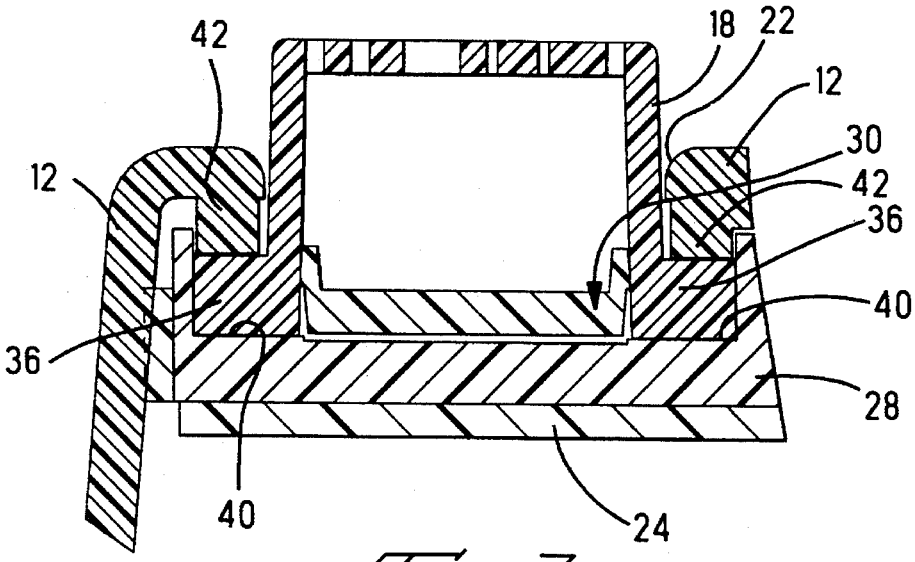
FIG. 3 is a cross-sectional view showing the assembled rocker switch.

FIG. 3 shows the rocker switch 18 assembled to the board 24 and the top housing 12. The rocker switch 18 has two pivot pins 36 which extend from either side of the switch 18. The bracket 28 is mounted onto the board 24. The pivot pins 36 are received into the cradle recesses 40 of the bracket 28. The silicon pad 30 is received between the switch 18 and the bracket 28. The top housing 12 has a projection 42 that extends from the top housing along the hole 22. The projection 42 is partially received into the cradle recess 40 and engages the top portion of the pivot pins 36 thereby securing the switch 18 in place, but still allowing the switch to be rocked forward and back.

Figure 4:
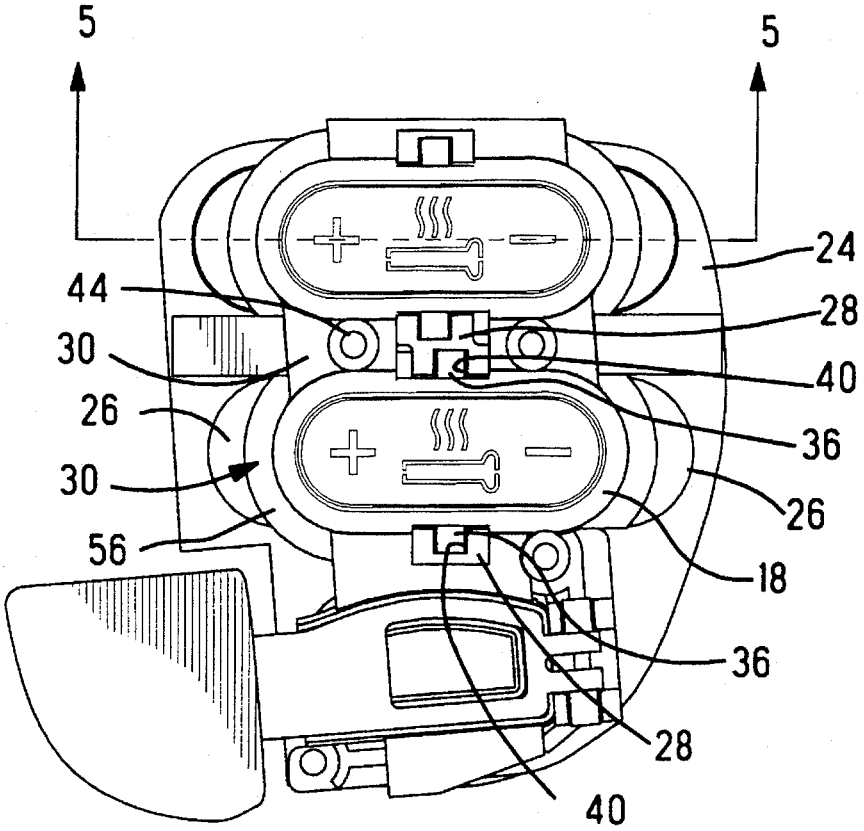
FIG. 4 is a top view of the assembled rocker switch.

FIG. 4 shows a top view of the assembly without the top housing 12. The pivot pins 36 are received within the cradle recess 40 of the mounting bracket 28. This view shows that the silicon pad 30 partially covers the bracket 28, but the upstanding projections which contain the cradle recesses 40 are projected through a hole in the silicon pad 30 so that the pivot pins 36 can be received within the cradle recesses 40. The silicon pad 30 has mounting holes 44 which are aligned with the mounting holes 38 of the bracket so that the mounting member can be accessed through the silicon paid 30.

Figure 5:
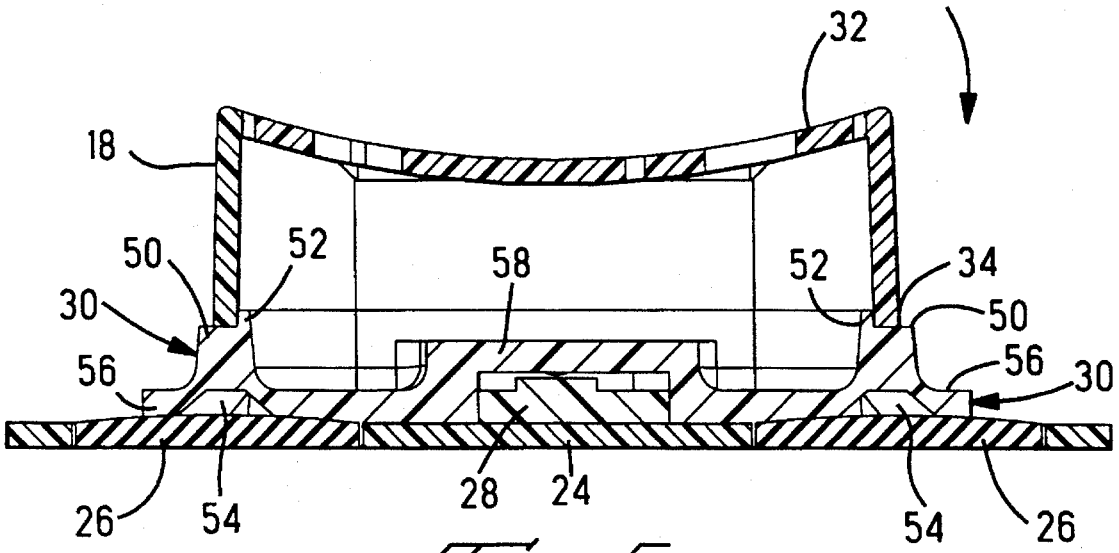
FIG. 5 is a cross-sectional view of the rocker switch taken along the line 5—5.

FIG. 5 shows a cross sectional view of the switch 18 mounted onto the circuit board 24. The bracket 28 is mounted on the board 24 and the silicon pad 30 is received over the bracket. The rocker switch 30 is then mounted thereon. The bottom surface 34 of the rocker switch rests on top of the silicon pad 30.

Figure 7:
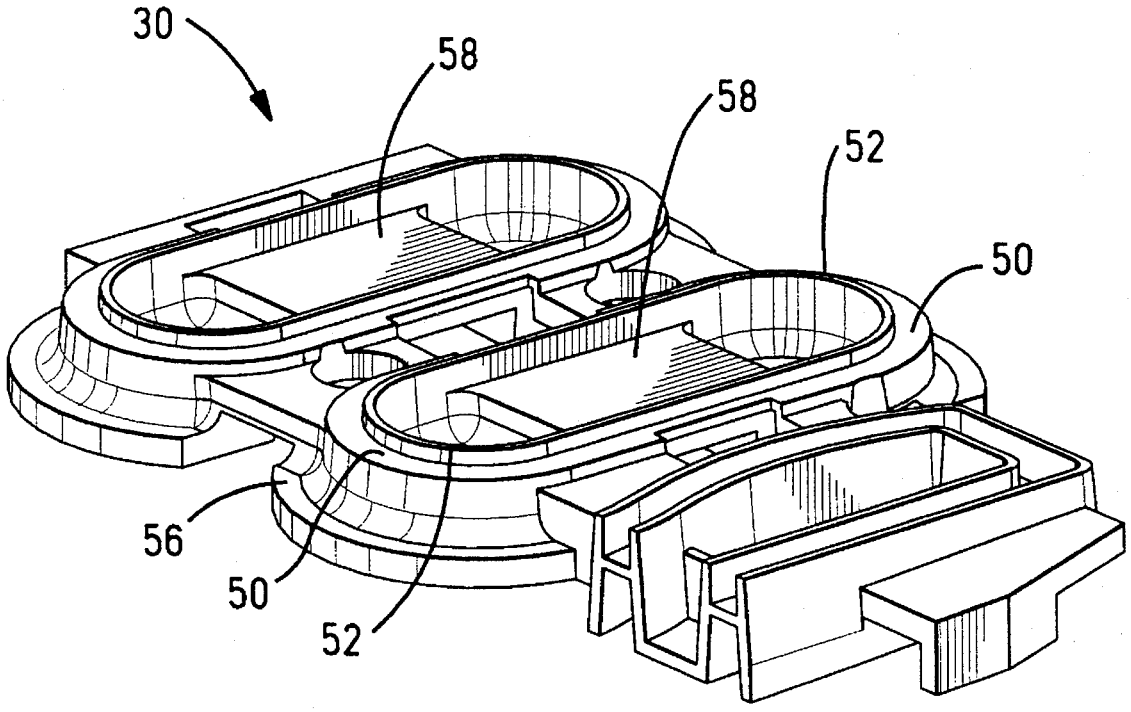
FIG. 7 is an isometric view of the silicon pad.

As can be seen in FIG. 5 and FIG. 7, the silicon pad 30 has a ledge 50 which is essentially the same shape as the bottom surface 34 of the rocker switch 18, extends around the switch 18 and on which the bottom 34 of the rocker switch 18 rests. An inner lip 52 extends upwardly from the ledge 50 and is received on the inside of the rocker switch. The inner lip 52 serves to keep the switch 18 and the pad 30 aligned with each other. Below the ledge 50, along the bottom surface of the pad 30, is a recess 54 which has an outer flange 56 extending outwardly from the recess. The portion of the silicon pad which is received under the rocker switch 18 has a ledge 58 which is received over the bracket 28. The silicon pad 30 is designed to minimized the amount of moisture that can accumulate between the pad and the dome switch 26. Even if moisture accumulates under the rocker switch 18, the silicon pad prevents most of the moisture from migrating to below the silicon pad 30.

Figure 6:
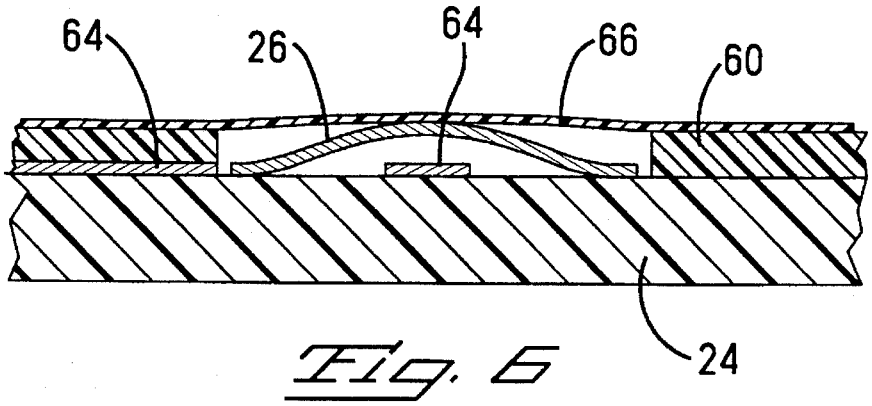
FIG. 6 is a cross-sectional view showing the components of the dome switch.

FIG. 6 shows the dome switch in more detail The dome switch 26 is mounted onto the board 24. If the dome switch is plastic, it is necessary to have a conductive pad mounted thereon, if it is metal, the conductive pad is unnecessary. The board 24 is covered by a membrane 66 which protects the dome switch and the board from moisture. When the dome switch is depressed, it engages traces 64 on the circuit board, thereby activating the appropriate switch. A layer of dielectric material 60 protects the traces 64 and also provides a recess in which the dome switch can occupy.

The operation of the rocker switch is described with reference to FIG. 5. The top surface 32 of the switch 18 is depressed by the operator. The bottom surface 34 of the switch 18 thereby depresses the silicon pad 30. The silicon pad 30 is depressed around the recess 54 thereby flattening the recess and pushing the flange 56 outwardly. The pressure from the silicon pad 30 then depresses the dome switch 26 which engages the traces 64 on the board 24 thereby performing the switching operation.

The use of the silicon pad 30 between the dome switch 26 and the rocker switch 18 provides greater travel of the switch so that the operator can feel that the switch has been operated. Further, the use of a metal or plastic dome switch provides for greater tactile feel for the operator.

The silicon pad prevents ice build-up on top of the dome switch 26 and the circuit board 24. In a snowmobile, it is not necessary to completely keep moisture out of the unit. However, the build up of ice on top of the dome switch would necessitate breaking that ice each time the switch is depressed. Because the silicon pad 30 is firmly secured against the circuit board 24, little moisture will accumulate between the silicon pad 30 and dome switch 26. Even if moisture accumulates under the rocker switch 18 the silicon pad prevents most of the moisture from migrating to below the silicon pad 30.

One further advantage to the present invention is that the silicon pad distributes the forces more evenly thereby preventing damage to the dome switches 18.

The rocker switch of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. A rocker switch, comprising:

a rocker member having an actuating surface, a bottom surface, and a pivot member;

a circuit board having a dome switch mounted thereon, the dome switch comprises a dome mounted onto the circuit board, the circuit board and the dome being covered by a protective membrane;

a bracket being secured to the circuit board having a pivot guide to receive the pivot member;

an elastomeric member being received between the bottom surface of the rocker member and the dome switch;

whereby actuation of the rocker member presses the bottom surface of the rocker member against the elastomeric member which presses against the dome switch thereby activating the switch.

2. The rocker switch of claim 1, wherein the dome switch comprises a metal dome.

3. The rocker switch of claim 1, wherein the elastomeric member includes a top surface and a bottom surface which is received against the circuit board, the top surface has a ledge to receive the bottom surface of the rocker member, the ledge extends completely around the periphery of the bottom surface of the rocker member.

4. The rocker switch of claim 3, wherein the bottom surface of the elastomeric member includes a recess with a ledge extending outwardly therefrom, the recess being below the ledge, as the rocker member is actuated, the bottom surface presses against the ledge which depresses the recess thereby flattening the recesses and spreading out the ledge.

5. The rocker switch of claim 4, wherein a lip extends upwardly from the ledge to be received along an inner side of the bottom surface of the rocker member thereby providing proper alignment of the rocker member and the elastomeric member.

6. The rocker switch of claim 1, wherein the elastomeric member partially seals the circuit board underneath the rocker member, thereby preventing too much moisture from accumulating on the circuit board under the rocker member and thereby causing icing problems.

7. The rocker switch of claim 6, wherein the elastomeric member has a ledge with a recess underneath to be received over top of a portion of a bracket while still sealing the circuit board underneath the rocker member.

8. The rocker switch of claim 1, wherein a top housing is secured over the rocker member, the top housing having a protrusion which cooperates with the pivot guide to secure the rocker member in position while allowing pivoting of the rocker member during actuation.

9. The rocker switch of claim 8, wherein the top housing has a hole through which the actuating surface extends to allow operator access to the actuating surface.

10. The rocker switch of claim 1, wherein the pivot member is a pin which extends outwardly from a side of the rocker member along the bottom surface.

11. A rocker switch, comprising:

a switch member having an actuation surface, a working surface, and a pivot member;

a circuit board having a dome switch thereon, the dome switch comprises a dome mounted onto the circuit board, the circuit board and the dome being covered by a protective membrane;

a bracket member being secured to the circuit board and having a pivot guide to position the switch member over the dome switch while allowing rocking motion thereof;

an elastomeric member received between the switch member and the circuit board;

whereby actuation of the switch member presses the working surface against the elastomeric member which presses the dome switch thereby activating the switch, the elastomeric member distributing forces across the circuit board thereby protecting the dome switch from high forces and preventing moisture from accumulating between the circuit board and the switch member to prevent ice damage to the circuit board and the dome switch.

12. The rocker switch of claim 11, wherein the dome switch comprises a metal dome.

13. The rocker switch of claim 11, wherein the elastomeric member includes a top surface and a bottom surface which is received against the circuit board, the top surface has a ledge to receive the working surface of the switch member, the ledge extends completely around the periphery of the working surface of the switch member.

14. The rocker switch of claim 13, wherein the working surface of the elastomeric member includes a recess with a ledge extending outwardly therefrom, the recess being below the ledge, as the switch member is actuated, the working surface presses against the ledge which depresses the recess thereby flattening the recesses and spreading out the ledge.

15. The rocker switch of claim 14, wherein a lip extends upwardly from the ledge to be received along an inner side of the bottom surface of the switch member thereby providing proper alignment of the switch member and the elastomeric member.

16. The rocker switch of claim 11, wherein the elastomeric member partially seals the circuit board underneath the switch member, thereby preventing too much moisture from accumulating on the circuit board under the switch member thereby preventing ice build up.

17. The rocker switch of claim 16, wherein the elastomeric member has a ledge with a recess underneath to be received over top of a portion of the bracket while still sealing the circuit board underneath the switch member.

18. The rocker switch of claim 11, wherein a top housing is secured over the switch member, the top housing having a protrusion which cooperates with the pivot guide to secure the rocker member in position while allowing pivoting of the switch member during actuation.

19. The rocker switch of claim 18, wherein the top housing has a hole through which the actuating surface extends to allow operator access to the actuating surface.

20. The rocker switch of claim 11, wherein the pivot member is a pin which extends outwardly from a side of the switch member along a bottom surface thereon.

* * * * *